United States Patent [19]

Cooper, Jr. et al.

[11] 4,327,957

[45] May 4, 1982

[54] ELECTRICAL TERMINAL LUG

[75] Inventors: James J. Cooper, Jr.; William C. Reinhardt; Elmer H. Hornung, all of St. Louis, Mo.

[73] Assignee: International Telephone and Telegraph Corporation, New York, N.Y.

[21] Appl. No.: 100,341

[22] Filed: Dec. 5, 1979

[51] Int. Cl.[3] ..... H01R 4/36

[52] U.S. Cl. ..... 339/272 R; 339/95 R

[58] Field of Search ..... 339/95 R, 272 R, 272 A, 339/250

[56] References Cited

U.S. PATENT DOCUMENTS

| | | | |
|---|---|---|---|
| 2,015,144 | 9/1935 | Hoover | 339/272 R |
| 2,083,923 | 6/1937 | Rowe | 339/272 R |
| 3,426,319 | 2/1969 | Downs et al. | 339/272 R |
| 3,760,341 | 9/1973 | Grad | 339/272 R |
| 4,146,290 | 3/1979 | Annas et al. | 339/95 R |

FOREIGN PATENT DOCUMENTS

| | | | |
|---|---|---|---|
| 1026840 | 2/1978 | Canada | 339/272 R |
| 1133788 | 11/1968 | United Kingdom | 339/95 R |

*Primary Examiner*—John McQuade

*Attorney, Agent, or Firm*—James B. Raden; William J. Michals

[57] ABSTRACT

An electrical connector for use with a stranded conductor cable includes a metallic terminal lug body having a longitudinally extending conductor bore hole extending from end to end thereof and having an attachment tang extending from one end of the body and parallel to the axis of the bore. The body includes a threaded bore extending from the upper surface, perpendicular to and into the conductor bore hole. The bottom of the threaded bore is coterminous with an undercut relief portion extending further into the conductor bore hole in the body of the terminal lug. A setscrew which includes a conically shaped conductor interface area and which is of the same alloy and material as the terminal body is received within the threaded bore for engaging the conductor strands in high contact pressure relationship therewith. The contact pressure results in moving and wiping of the conductor strands against each other, and against the conductor bore hole and the setscrew which removes oxidation from the strand surfaces. The contact pressure also results in a cold flow and deformation of a portion of the cable strands into the undercut relief which further locks the cable into the terminal body and provides a lower resistance electrical connection.

3 Claims, 6 Drawing Figures

ELECTRICAL TERMINAL LUG

BACKGROUND OF THE INVENTION

This invention relates to electrical connectors and, more particularly, to such connectors for terminating the exposed end of a stranded cable conductor into the body of the connector by means of a threaded fastener such as a setscrew.

Electrical terminal lug connectors for providing electrical and mechanical termination of a stripped stranded wire cable conductor are known and have been widely used in the art. These devices generally comprise a terminal lug body having a longitudinally extending conductor receiving bore therein and a threaded setscrew receiving bore therein which is perpendicular to the longitudinal axis of the conductor bore. The setscrew compressively engages the stranded wire bundle to complete the mechanical and electrical connection. Although these electrical connectors have been widely used in the art, they fail to consistently achieve good conductor holding ability and low resistance electrical connection characteristics particularly in environments having wide ambient temperature variations. For example, the industry has proposed a standard known in the art as the U/L 486B connector test which requires that the connection attain given mechanical and electrical specifications including specified performance in an elevated temperature heat cycle test. It has been found that many of these prior art electrical connectors fail to consistently attain such rigorous electrical and mechanical specifications. It has also been found that some of these devices tend to mechanically fail as the required torque specification is applied to the threaded fastener or setscrew.

Improvements in electrical connectors of the abovementioned type are also known and have been widely used in the art. The improved devices are exemplified and discussed in U.S. Pat. No. 4,146,290 which discloses such an electrical terminal lug connector wherein an additional set of apertures or windows are provided along the side walls of the connector and extend inwardly into the body of the connector in a direction which is transverse to the axis of both the conductor receiving bore hole and the threaded setscrew receiving bore hole. These apertures or windows function to provide improved mechanical and electrical connections in that as the setscrew is torqued to the recommended setting, the wire strands are slightly bulged into the apertures or windows creating a relatively firm, low resistance connection. The present invention provides a further improvement in electrical terminal lugs and which has been found to attain the specifications mandated by the abovementioned industry standard.

SUMMARY OF THE INVENTION

Briefly, an electrical terminal lug connector for use with a given diameter stranded cable conductor having a generally round cross section is provided. The connector includes a terminal lug body having a conductor receiving bore hole extending therethrough from end to end thereof. A threaded bore extends from an upper surface of the body which is parallel to the axis of the conductor bore hole, through the axis of the conductor bore hole and terminates into the lower portion of the conductor bore hole. A setscrew is threadedly received in the threaded bore for engagement with the stranded conductor. The lower portion of the conductor bore hole includes an undercut relief portion adjacent to and coaxial with the threaded bore for receiving deformed portions of the cable which extend radially outwardly of the normal circumference of the cable conductor.

BRIEF DESCRIPTION OF THE DRAWING

The advantages of this invention will become more readily appreciated as the same becomes completely understood by reference to the following detailed description when taken in conjunction with the accompanying drawing wherein.

DETAILED DESCRIPTION

Figure 1:
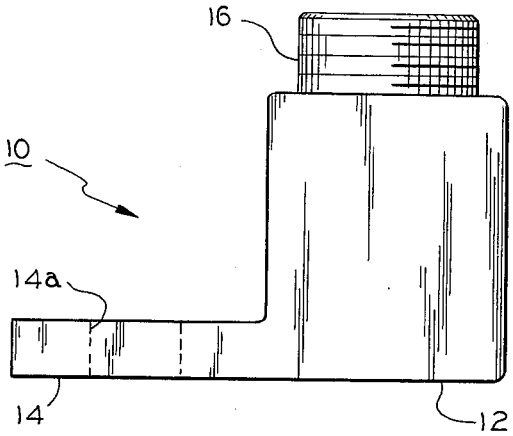
FIGS. 1 and 2 provide plan and top views of the electrical terminal lug connector in accordance with the present invention.
Figure 2:
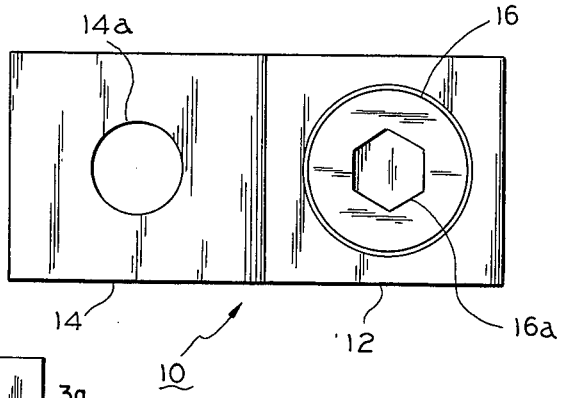

Referring now to FIGS. 1 and 2 there is shown generally at 10 plan and top views respectively of the terminal lug connector in accordance with the present invention. Connector 10 includes a metallic terminal lug body 12 having an attachment tang 14 extending from one end of the body 12 for attachment to external means (not shown) as by way of a fastener inserted through bore hole 14*a*. Connector 10 further includes a setscrew 16 which is received within a threaded bore of connector 10 as described more fully hereinafter. Setscrew 16 may comprise a headless setscrew having a hexagon-shaped recess 16*a* which forms a socket for receiving an external torque tool. In accordance with a feature of the present invention, body 12 and setscrew 16 comprise the same alloy of the same material. This relationship has the advantage that all of the characteristics of the components are essentially identical and, therefore, respond to temperature changes as a unit and not as independent components.

Figure 3B:
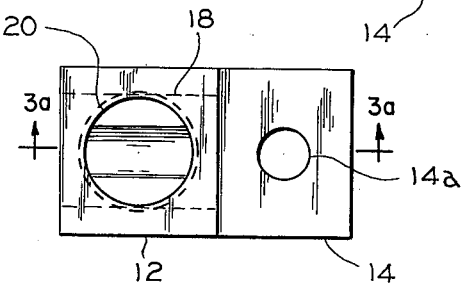
FIGS. 3*a*–3*c* provide various views of the connector of FIGS. 1 and 2 and further illustrate the structural relationship of the internal bore holes and associated structure in accordance with the principles of the present invention; and, FIG. 4 is a cross-sectional view similar to FIG. 3*c* and which is further illustrated in conjunction with a setscrew engaging the exposed end of a stranded cable conductor.
Figure 3A:
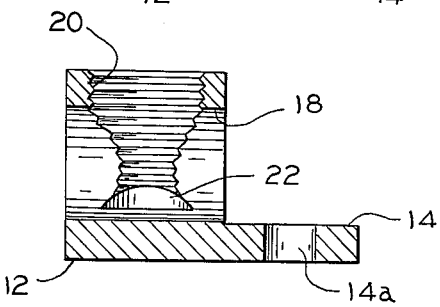
Figure 3C:
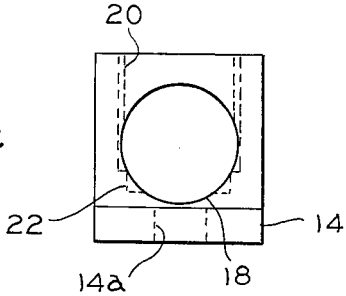

Referring now to FIGS. 3*a*–3*c* there are shown cross-sectional, top and end views, respectively, of connector 10 of the previous drawing figures. It can be seen that body 12 further includes a longitudinally extending conductor bore hole 18 extending from opposite ends of body 12 and generally parallel to tang portion 14. Body 12 further includes a threaded bore hole 20 extending from the upper surface of body 12 into the lower portion of body 12 and perpendicular to conductor bore hole 18. It can be seen that threaded bore hole 20 extends into body 12, through the axis of conductor bore hole 18 and terminates into the lower portion of conductor bore hole 18 beween its axis and the round bottom portion thereof. The lower portion of threaded bore hole 20 is coterminous with, and coaxially disposed with relation to, an undercut relief portion 22 which extends a given distance into conductor hole 18 of body 12 and is formed such as by drilling the subsequently tapped hole a given distance past the intended threaded portion of threaded bore hole 20. This operation may necessitate end milling to achieve the desired depth without scarring or penetrating the round bottom segment of the conductor receiving bore 18.

Figure 4:
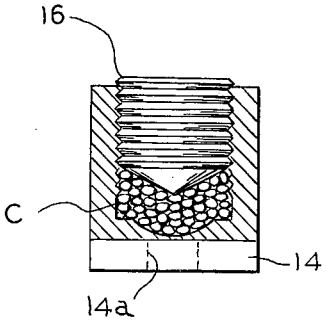

Referring now to FIG. 4 there is shown an end view similar to FIG. 3*c* but which further illustrates connector 10 in conjunction with setscrew 16 and the strands of the stripped end of a cable conductor C after installation—i.e., once the setscrew 16 is advanced into compressive engagement with cable C. It can be seen that undercut relief portion 22, in cooperation with the associated structure of the terminal lug, permits the conductor strands to cold flow, or to be deformed into, this area under high contact pressure as provided by setscrew 16. This action not only facilitates locking of the conductor into body 12 of connector 10 under setscrew 16, but also permits the conductor strands to move and wipe against each other under the high contact pressure applied by operation of setscrew 16.

The function provided by the structure of undercut relief portion 22 wherein the strands of the cable are moved and wiped against each other, the conductor hole, and the setscrew 16, functions to remove oxidation on the surface of the strands and results in a low resistance electrical connection not only between the individual strands but the wall of conductor hole 18, the undercut relief area 22 and setscrew 16 as well. Further, the cold flow or deformation of a portion of the normally circular cross section of conductor C into relief area 22, in conjunction with the conical shape of setscrew 16 under high contact pressure, results in a low resistance connection and which also locks the conductor to meet conductor secureness and pullout requirements.

In currently preferred practice, the cross-sectional area of conductor hole 18 is selected to be in a range of 1.6 to 2.0 times the total area of the maximum conductor size for which the terminal is adapted. It has been found that this range of value with respect to the maximum size conductor provides optimum performance with respect to low resistance and a mechanically secure connection. In currently preferred practice, the common material of setscrew 16 and connector body 12 comprises a conductive aluminum material such as 6061-T6 aluminum. It will now be appreciated by those skilled in the art, that the enlarged conductor hole size and undercut relief portion area in conjunction with the operation of the conical shaped conductor interface area of the setscrew permits the strands of the conductor to move and wipe against each other under high contact pressure to remove oxidation from the surfaces of the strands. This structure further functions to cold flow or deform the normal cross section of the conductor into the undercut relief area under the setscrew which thereby serves to mechanically lock the cable conductor and provide a low resistance electrical terminal lug connection. Finally, the structural relationship which follows from the use of the same alloy in both the terminal lug body and the setscrew results in optimum performance of the connector, in accordance with the present invention, during heat cycle testing and wide ambient temperature variation applications.

What has been taught, then, is an electrical terminal lug connector for locking and making a low resistance electrical connection to a cable conductor and facilitating, notably, a moving and wiping action of the individual strands of the cable so as to remove oxidation from the individual cable strands. The form of the invention illustrated and described herein is but a preferred embodiment of these teachings, in the form currently preferred for manufacture. It is shown as an ilustration of the inventive concepts, however, rather than by way of limitation and it is pointed out that various modifications and alterations may be indulged in within the scope of the appended claims.

What is claimed is:

1. An electrical terminal lug connector for use with a given maximum diameter stranded cable conductor having a generally round cross section and comprising:

a terminal lug body having a conductor receiving bore hole extending therethrough from end to end thereof;

a threaded bore extending from an upper surface of said body which is parallel to the axis of said conductor bore hole, through the axis of said conductor bore hole and terminating into the lower portion of said conductor bore hole;

a setscrew threadedly received in said threaded bore for engagement with said stranded conductor; and, wherein said lower portion of said conductor bore hole includes an undercut relief portion spaced apart from the round bottom portion of said bore hole and extending upwardly adjacent to and generally coaxial with said threaded bore for receiving deformed portions of said cable which extend radially outwardly of the normal circumference of said cable conductor.

2. The lug connector according to claim 1, wherein said setscrew and said terminal lug body each comprise the same material.

3. The lug connector according to claim 2, wherein said setscrew and said terminal lug body each further comprise the same alloy of said material.

* * * * *